US005762795A

United States Patent [19]

Bailey et al.

[11] Patent Number: 5,762,795

[45] Date of Patent: Jun. 9, 1998

[54] DUAL STAGE PUMP AND FILTER SYSTEM WITH CONTROL VALVE BETWEEN PUMP STAGES

[75] Inventors: David C. Bailey; Carl A. Martin, both of San Jose, Calif.

[73] Assignee: Cybor Corporation, San Jose, Calif.

[21] Appl. No.: 590,260

[22] Filed: Jan. 25, 1996

Related U.S. Application Data

[63] Continuation of Ser. No. 62,871, May 17, 1993, Pat. No. 5,490,765.

[51] Int. Cl.[6] ..... B01D 35/00

[52] U.S. Cl. ..... 210/416.1; 222/189.06; 222/255; 417/313; 417/426; 210/424

[58] Field of Search ..... 210/143, 257.1, 210/257.2, 258, 416.4, 416.5, 741, 767, 808, 136, 141, 424, 416.1; 417/246, 313, 383, 395, 426, 540; 222/189.06, 255

[56] References Cited

U.S. PATENT DOCUMENTS

| | | | |
|---|---|---|---|
| 3,777,888 | 12/1973 | Zellbeck et al. | 210/416.1 |
| 4,618,425 | 10/1986 | Yates | 210/416.1 |
| 4,690,621 | 9/1987 | Swain | 210/416.1 |
| 4,915,597 | 4/1990 | Moore | 210/416.1 |
| 4,950,134 | 8/1990 | Bailey et al. | 417/383 |
| 5,167,837 | 12/1992 | Snodgrass et al. | 210/767 |
| 5,262,068 | 11/1993 | Bowers et al. | 210/767 |
| 5,490,765 | 2/1996 | Bailey et al. | 417/313 |
| 5,516,429 | 5/1996 | Snodgrass et al. | 210/767 |

OTHER PUBLICATIONS

Control of the Surface-Water Purification Plant for the Amsterdam Water-Supply Authority, Philips Technical Review, vol. 36, 1976, No. 10, pp. 273–283, M. Klinck.

*Primary Examiner*—Joseph W. Drodge

[57] ABSTRACT

An improved dual-stage pump system is provided for the accurate pumping and filtering of viscous fluids. Two hydraulically activated pumps are provided in series with a filter and reservoir disposed in-line between the two pumps. The reservoir acts as a source bottle for the second pump and allows the first pump to pump the viscous fluid through the filter at a rate independent of the dispensing rate of the second pump. By operating the first pump at a rate independent of the second pump, back pressure at the filter is avoided. Each hydraulically activated diaphragm pump is equipped with an improved diaphragm that is pre-formed to the geometries of the process fluid cavity thereby eliminating any inaccuracies in the operation of the pumps due to expansion of retraction of the diaphragm during pump operation.

1 Claim, 8 Drawing Sheets

DUAL STAGE PUMP AND FILTER SYSTEM WITH CONTROL VALVE BETWEEN PUMP STAGES

This is a continuation of application Ser. No. 08/062,871, filed on May 17, 1993, now U.S. Pat. No. 5,490,765.

FIELD OF THE INVENTION

This invention relates generally to a pumping, filtering and reservoir system for use in dispensing precise amounts of viscous liquids at precise rates. More particularly, the present invention relates to an improved dual stage pumping system with in-line filter and reservoir systems disposed between the two pumps connected in series and further with improved pump accuracy due to pre-formed pump diaphragms.

BACKGROUND OF THE INVENTION

The manufacture of multi-chip modules (MCM), high-density interconnect (HDI) components and other semiconductor materials requires the application of a thin layer of polyamide material as an inner layer dielectric. The polyamide material must be filtered and then applied with exacting precision because the required thicknesses of the polyamide film may be as small as 100 microns and the final thickness of the polyamide film must be uniform and not normally vary more than 2% across the substrate or wafer.

In this connection, numerous problems arise with the construction and operation of a pump/filter apparatus that will supply polyamide material in exacting amounts and in a timely manner.

In addition to the unique mechanical and electrical properties that make polyamides ideally suited for use in the manufacture of semiconductors, polyamides also have physical properties that make it difficult to pump or supply the polyamides in exacting amounts. Specifically, polyamides are viscous; most polyamides used in the manufacture of semiconductors have viscosities in excess of 400 poise. Fluids with viscosities this high are difficult to pump and difficult to filter. Pumping a viscous fluid through a submicron filter can create high back pressures at the filter element.

Further, the viscosity of polyamide fluids can vary with time and temperature. Essentially, polyamide fluids must be date coded and viscosity measurements are valid for only relatively short periods of time, perhaps 10 days. It is known in the art that recirculation of polyamide fluids helps stabilize the viscosity. However, because polyamide fluids are viscous and the viscosity of the polyamide fluids is dependent on temperature, excessive recirculation may increase the temperature of the fluid and thereby alter the viscosity. Of course, changes in the fluid viscosity will affect the operation and performance of pumps used to dispense the fluid.

Pumps used in dispensing polyamide fluids must also be precise because of the high cost of the fluids. It is not uncommon for polyamide fluids to cost in excess of $15,000 per gallon. Therefore, it is important that pump systems used to dispense the polyamide fluids dispense the exact amounts, without waste.

At least three techniques are used for applying polyamide films to substrates during the manufacture of semiconductors. Those methods include applying a drop of polyamide material to the center of a substrate wafer following by rotation of the wafer to evenly distribute the polyamide across the wafer. However, in this system, a substantial amount of polyamide liquid is spun from the wafer and then discarded, resulting in loss of the expensive polyamide liquid. A second method includes the deposit of polyamide liquid on a rotating wafer. In this method, the dispense rate and amount must be tightly controlled so that the dispense pattern is consistent from one wafer to the next.

A third and more recent method is known as liquid extrusion. In this method, an exacting amount of polyamide liquid is applied to the wafer in a single pass. It is anticipated that liquid extrusion systems or similar methods will eventually replace the aforenoted methods that include rotation of the wafers.

The polyamide liquids are dispensed with pumps such as the ones shown in U.S. Pat. Nos. 5,167,837 and 4,950,134. The present invention provides a substantial contribution to the art of precision fluid pumping and to the designs disclosed in U.S. Pat. Nos. 5,167,837 and 4,950,134 by providing a reservoir disposed between the two pumps and further by providing an improved control system and recirculation system. Additionally, the diaphragm pumps disclosed in both U.S. Pat. Nos. 5,167,837 and 4,950,134 are prone to inaccuracies due to stretching of the diaphragm during operation of the pumps.

During the dispense and reload strokes of a diaphragm pump, pressure is exerted on the diaphragm causing the diaphragm to stretch. At the end of the dispense or reload stroke, some residual resilience exists in the rubber material comprising the diaphragm. This residual resilience can cause unwanted forces to be exerted on the fluid in the system. These forces cause small displacements of fluid leading to pump inaccuracies. The present invention provides a solution to this problem by pre-stressing the pump diaphragm to its maximum size during manufacture of the diaphragms, thereby reducing or eliminating residual resilience in the diaphragm.

Thus, the present invention is directed to improved dual-stage pumps systems for the precise dispensing of polyamide fluids and other viscous fluids that includes a separate reservoir disposed between the two pump units, a recirculation system and pre-formed pump diaphragms for enhanced pump accuracy.

SUMMARY OF THE INVENTION

The dual stage pump system of the present invention includes a first pump for receiving and dispensing fluid from a fluid source or source bottle. The first pump, or first pumping means, pumps the fluid through a filter, or filtering means. After the fluid is filtered, the pressure exerted by the first pump causes it to travel through a conduit and into a reservoir, or reservoir means. The reservoir acts as a source bottle for the second pump, or second pumping means. The second pump draws fluid from the reservoir and dispenses it in precise amounts.

Three separate three-way solenoid valves are employed in the preferred embodiment of the present invention. A first three-way solenoid valve is disposed between the first pump, the source bottle and the filter. The valve allows communication between the source bottle and first pump and, alternatively, the first pump and the filter. A second three-way solenoid valve is disposed between the reservoir, the second pump and the recirculation/dispensing system. A third three-way solenoid valve is disposed between the second pump, the dispense nozzle and the recirculation conduit. This valve allows communication between the second pump and the dispense nozzle and, alternatively, the second pump and the recirculation conduit.

If the application of submicron filtration to high viscosity fluids is slower than the amount of fluid required by the dispensing pump, i.e. the second pumping, the viscous fluid cannot be filtered at a rate equal to the dispense rate. The present invention solves this problem by providing a first pump which operates at a rate independent of the second pump. The first pump forces fluid from the source bottle through the submicron filter and into the reservoir, which acts as a source bottle for the second pump. Further, by having filtered fluid contained in the reservoir for use by the second pump, the first pump can operate at a slow rate thereby avoiding the creation of substantial back pressure at the filter. While the filter size and fluid viscosity are important factors in the creation of back pressure, the filtration rate, or the first pumping rate of the first pump may be slow enough so as to avoid this occurrence.

A controller means along with pressure sensing means disposed in the first pump and the second pump control the amount of fluid that is maintained in the reservoir. The controller stores input values for filtration rate and filter size. The operator must program a first pumping rate for the first pump that is compatible with the filter size and fluid viscosity. The operator also chooses a required second pumping rate or required dispense rate. If the second pump is not dispensing and the fluid level in the reservoir is low, then the controller either continues or initiates operation of the first pump. If the second pump is operating and the first pump is pumping fluid through the filter, the controller reads the pressure at the first pump to determine if significant back pressure exists at the filter. If back pressure exists, then the first pump is shut off. If no back pressure exists and the reservoir pressure is low, then the first pump continues or starts pumping.

Both pumps are preferably hydraulically activated diaphragm pumps. A diaphragm is disposed across the cavity and divides the cavity into two parts: a process fluid cavity and a hydraulic fluid cavity. The pumps apply pressure to the hydraulic fluid which pushes the diaphragm through and into the process fluid cavity thereby displacing the process fluid or the polyamide fluid contained therein.

The diaphragms are pre-stressed when manufactured against the tooling of like or near identical size to the process fluid cavity. In pre-stressing the diaphragms, the diaphragm is placed in the tooling and sealed with an O-ring and face seal. An appropriate pre-form is secured to the tooling. The diaphragm is pressurized at approximately 60 PSI with air for approximately 30 minutes. Then, the diaphragm is sized for a stressed volume and shape substantially equal to the process fluid cavity. Therefore, at the end of the dispense stoke of the pump, the diaphragm will not stretch and will not thereafter retract as the pump moves toward the reload stroke. By avoiding stretching and retracting of diaphragms during pump operation, the present invention provides a more accurate hydraulically activated diaphragm pump.

It is therefore an object of the present invention to provide an improved dual-stage pump system for the filtering and pumping of high viscosity fluids.

Another object of the present invention is to provide a reservoir means for accumulating filtered fluid and acting as a source bottle for a second pump of a dual-stage pump system.

Another object of the present invention is to provide a recirculation system to preserve the viscosity of high viscosity fluids dispensed in dual-stage pumping systems.

Yet another object of the present invention is to improve the accuracy of hydraulically activated diaphragm pumps by providing an improved diaphragm which is pre-formed to the size of the process fluid cavity or the maximum displacement geometry.

BRIEF DESCRIPTION OF THE DRAWINGS

This invention is illustrated diagrammatically in the accompanying drawings, wherein.

DETAILED DESCRIPTION OF THE INVENTION

Figure 2:
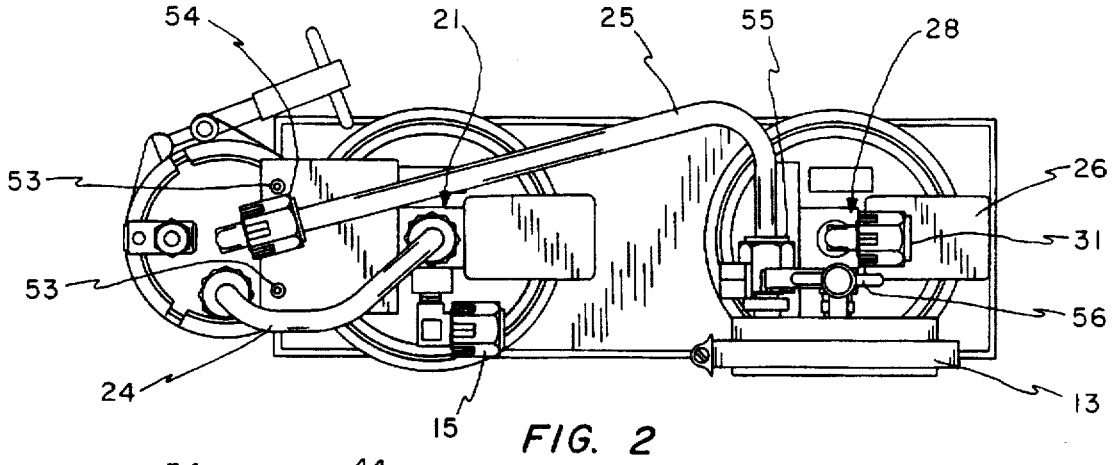
FIG. 2 is a top view of the dual-stage pump system shown in FIG. 1.

Like reference numerals will be used to refer to like or similar parts from figure to figure in the following description of the drawings.

Figure 1:
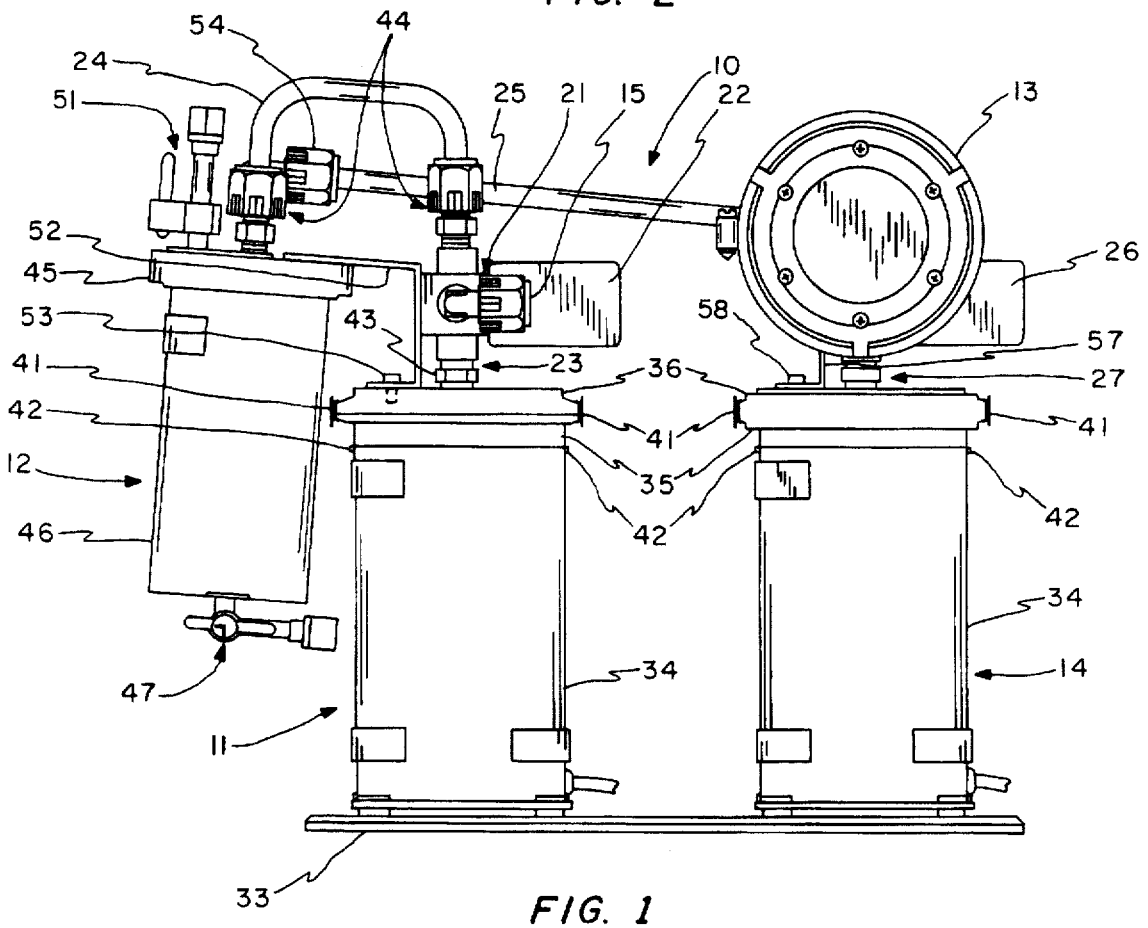
FIG. 1 is a front elevational view of a dual-stage pump system made in accordance with the present invention.

The dual-stage pump system 10 shown in FIGS. 1 and 2 includes a first pump or first pumping means 11 connected to a filter or filtering means 12 connected to a reservoir or reservoir means 13 connected to a second pump or second pumping means 14. The first pump 11 draws fluid through the inlet port 15 when connected to a source bottle 16 or recycled fluid through a recirculation line 17 (not shown in FIGS. 1 or 2 (see FIG. 8). The fluid enters the three-way valve 21 which is controlled by the solenoid 22. The path from the inlet 15 through the conduit 23 allows fluid to enter into the first pump 11. When the first pump 11 dispenses, the solenoid 22 activates the valve 21 to close the path between the conduit 23 and the inlet 15 thereby opening the path between the conduit 23 and the conduit 24 which allows fluid to enter into the filter 12. After the pump 11 completes its dispensing stroke, the solenoid 22 reopens the pathway between the inlet 15 and the conduit 23 thereby allowing the pump 11 to commence its reload stroke and take in fresh fluid from the inlet 15.

Figure 8:
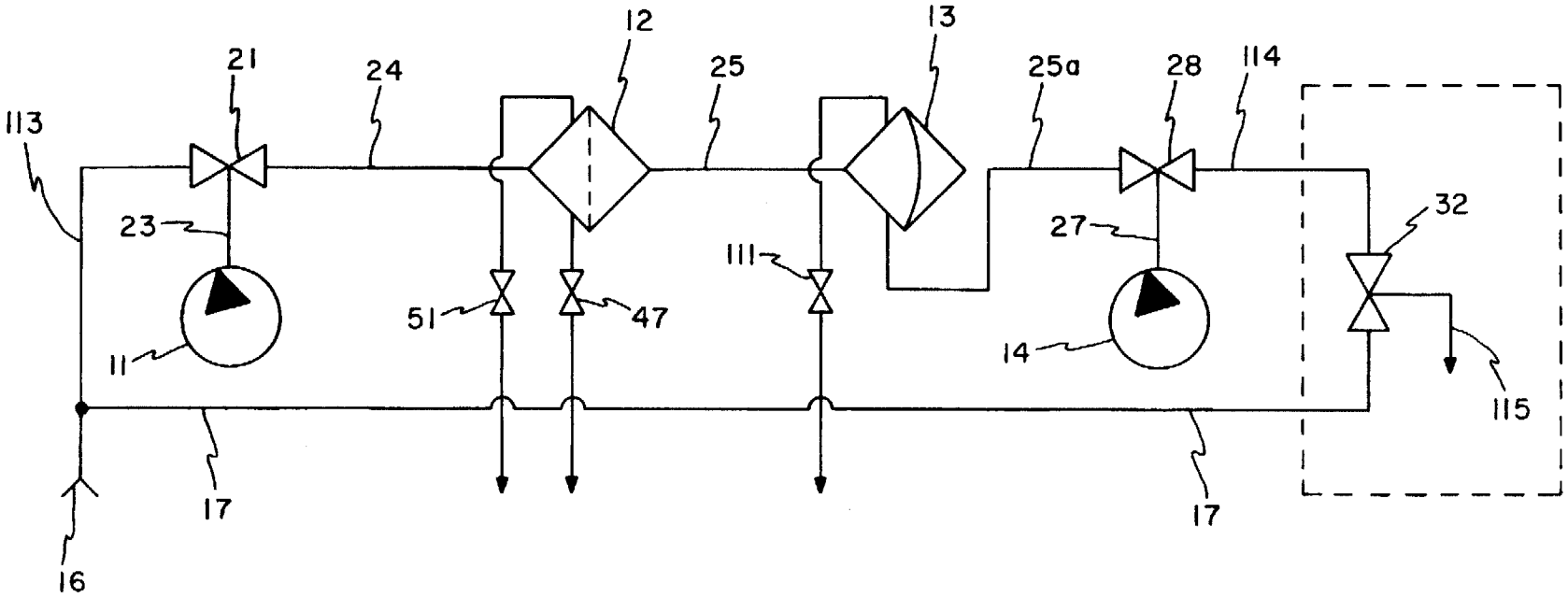
FIG. 8 is a fluid flow diagram of the dual-stage pump system shown in FIG. 1.

The filter 12 is a submicron filter. After the fluid has been filtered through the filter 12, pressure from the pump 11 pushes the fluid through the conduit 25 and into the reservoir 13. The reservoir 13 acts as a source bottle for the second pump 14. Before the second pump 14 begins its reload stroke, the solenoid 26 activates the three-way valve 28 to open communication between the reservoir 13 and the second pump 14 by allowing fluid to pass through the conduit 27. After the pump 14 completes its reload stroke, the solenoid 26 closes this pathway and opens the pathway between the conduit 27 (see FIG. 1) and the outlet 31 (see FIG. 2). The outlet 31 is connected to yet another solenoid controlled three-way valve 32 as shown in FIG. 8.

Returning to FIGS. 1 and 2, the construction of the dual-stage pump system 10 is as follows. The first and second pumps 11, 14 may be mounted on a common platform 33. Each pump 11, 14 includes a casing 34. Two opposing bodies 35, 36 contain the hydraulic cavity 37 and process fluid cavity 38 (see FIG. 3). The opposing bodies are held together by tension brackets 41. A pair of elongated fasteners extend through the sealed bottom 61 to the lower body 35, clamping the casing 34 between the sealed bottom 61 and the lower body 36. A pair of circumferential sealing rings 42 are placed on each end of the casing 34.

The fitting 43 connects the pump 11 to the three-way valve 21. Like threaded fittings indicated generally at 44 connect the three-way valve 21 to the conduit 24 and the conduit 24 to the filter top 45 which is mounted onto the filter casing 46. A drain 47 and vent 51 are disposed on either end of the filter 12. The filter is mounted to the first pump via the bracket 52 and screws, indicated generally at 53.

The threaded couplings 54 and 55 connect the conduit 25 to the filter 12 and the reservoir 13. The reservoir 13 includes a vent 56. The reservoir 13 is mounted to the filter 14 via the bracket 57 and screws 58.

Figure 3:
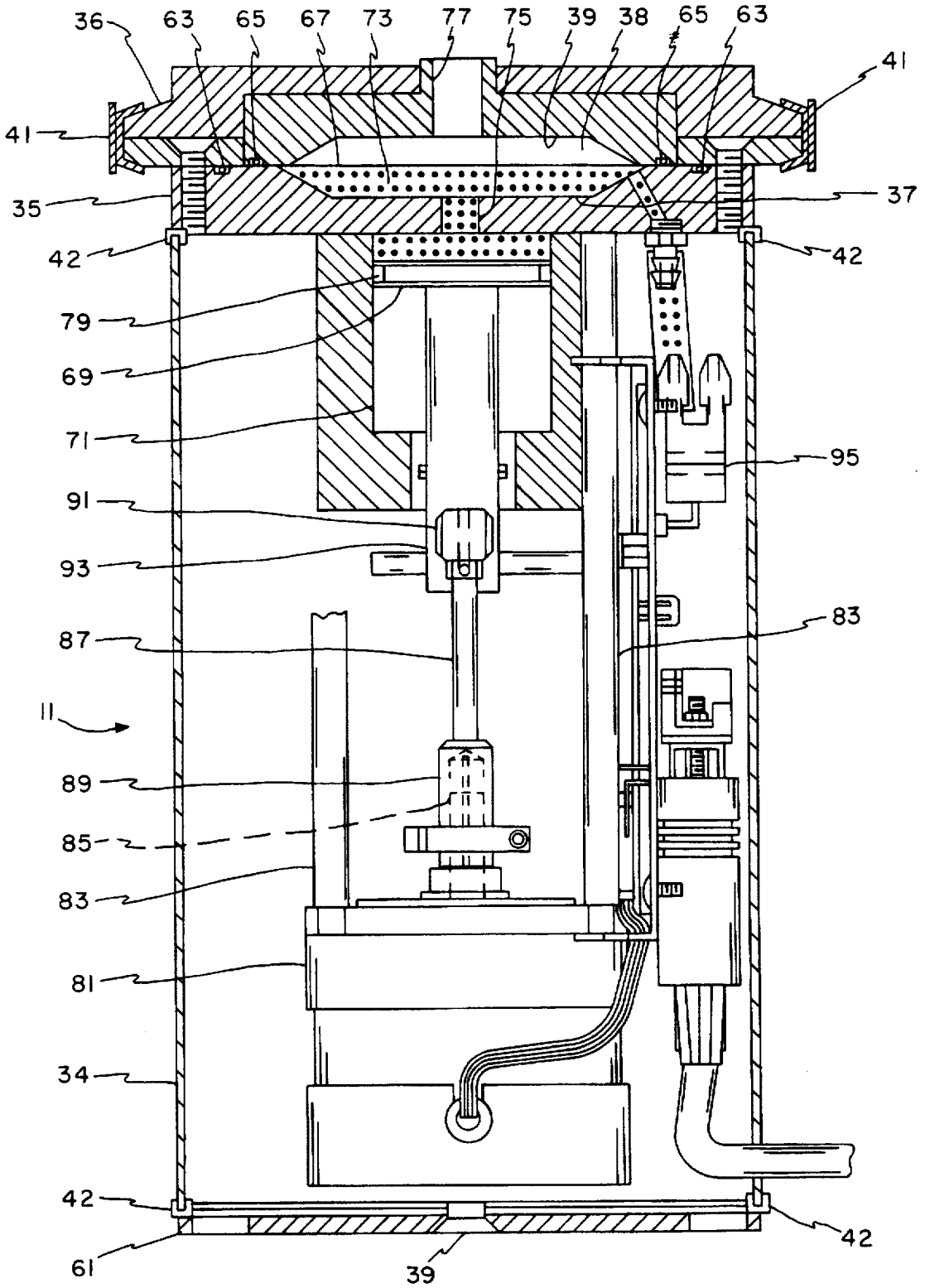
FIG. 3 is a front sectional view of a hydraulically activated diaphragm pump suitable for use in the dual-stage pump system, such as the one shown in FIG. 1.
Figure 6:
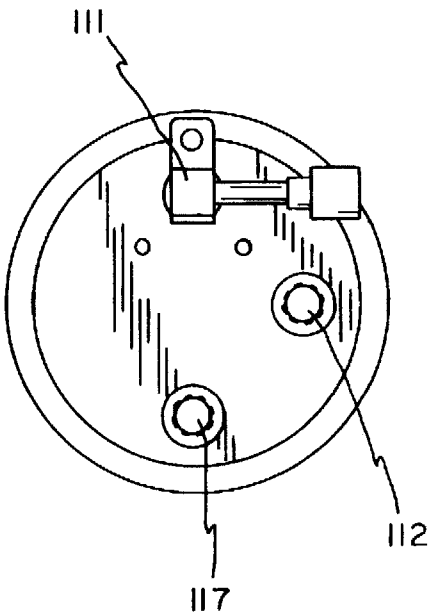
FIG. 6 is a rear elevational view of the fluid reservoir shown in FIG. 4.
Figure 5:
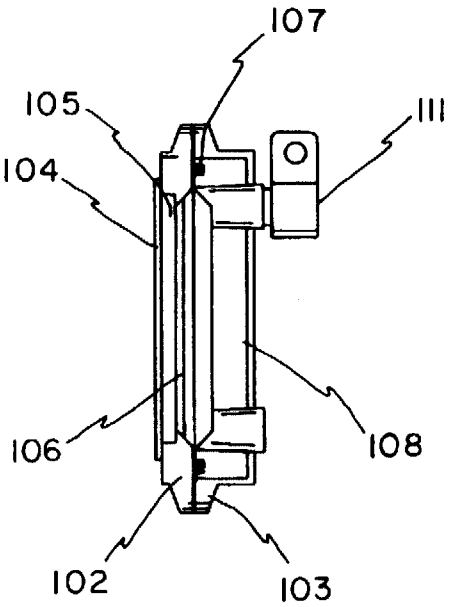
FIG. 5 is a left side view of the fluid reservoir shown in FIG. 4.

Turning the FIG. 3, a more detailed view of the first pump 11 is provided and the first pump 11 is preferably of the same or similar design as the second pump 14. However, the two pumps could be different in their capacity, design or method of operation. Each pump includes a casing 34 which is held between a sealed bottom 61 on one end and the body 35 on the other end. The casing 34 houses the hydraulic fluid cavity 37. O-rings 63 and 65 form a between the body 35 and the body 36.

The pump 11, as shown in FIG. 3, is at the end of the dispense stroke and/or at the beginning of the reload stroke. The diaphragm 67 extends straight across the midway point between the hydraulic fluid cavity 37 and the process fluid cavity 38. During the dispensing stroke, the piston 69 will move upward through the cavity 71 and will push the hydraulic fluid, indicated generally at 73, from the cavity 71 through the opening 75 which will push the diaphragm 67 upward toward the walls 39 of the process fluid cavity 38. The process fluid, which is contained in the process fluid cavity 38, will be pushed upward and out of the outlet 77 towards the three-way valve 21 in the case of the first pump 11, or the three-way valve 28 in the case of the second pump (see FIG. 2). The piston 69 includes a sealing ring 79 to prevent leakage of the hydraulic fluid 73 below the piston 69 into the lower part of the cavity 71.

The raising and lowering of the piston 69 is accomplished in a manner similar to that shown in U.S. Pat. No. 4,950,134, a patent which is assigned to the assignee of the present invention and which is incorporated herein by reference. A stepper motor 81 is mounted to the body 35 by the fixtures 83. The motor shaft 85 is fixedly connected to the drive shaft 87 by the coupling 89. The head 91 of the drive shaft 87 is preferably threaded (not shown) and provides a threaded male connection inside the piston coupling 93. Therefore, radial rotational movement of the motor shaft 85 is converted into linear vertical movement of the piston 69 as the threaded drive shaft head 91 twists inside the piston coupling 93 thereby raising and/or lowering the piston 69. A pressure transducer 95 is provided in each pump 11, 14. The value transmitted from the pressure transducers 95 is used by the controller as described below.

Figure 4:
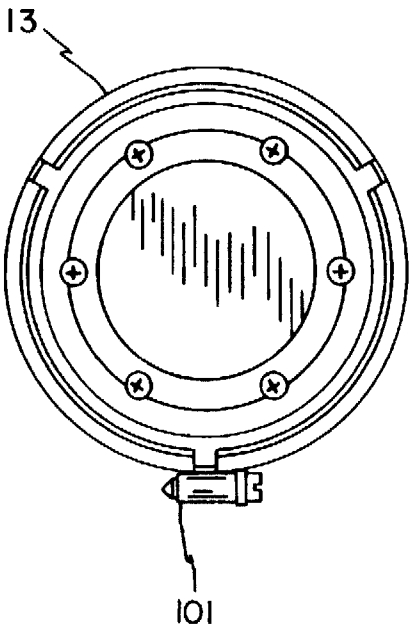
FIG. 4 is a front elevational view of a fluid reservoir made in accordance with the present invention and shown in FIG. 1.
Figure 7:
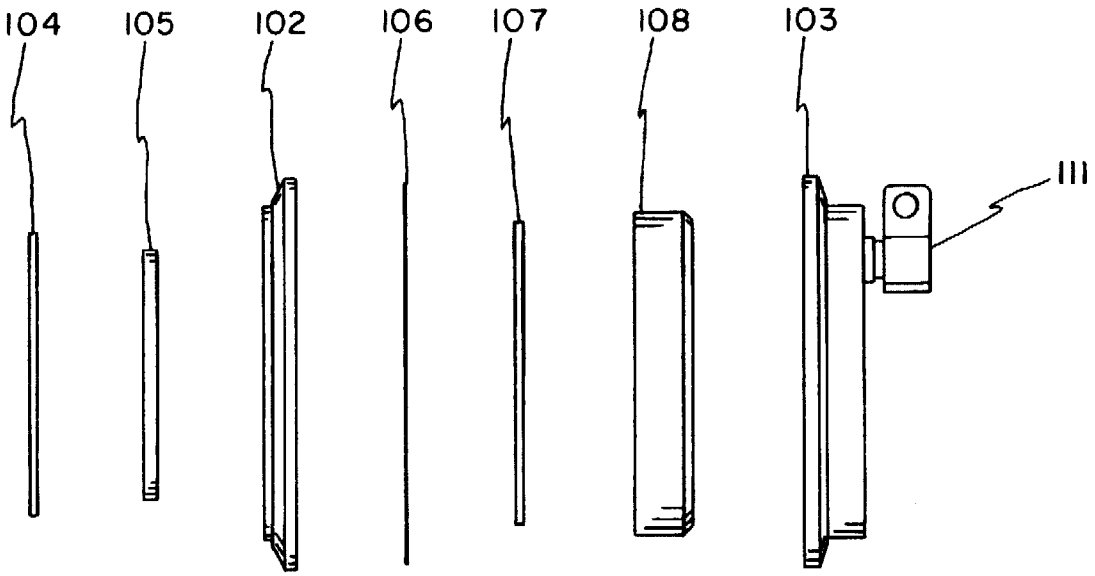
FIG. 7 is an exploded left side view of the reservoir shown in FIG. 4.

FIG. 4 is a front elevational view of the reservoir 13 which is preferably mounted on top of the second pump 14 but need only be disposed in-line between the filter 12 and the second pump 14.

Referring to FIGS. 4 through 7 collectively, the reservoir includes a V-clamp 101 which secures the face seal flange 102 to the casing 103. A retaining site glass 104 is disposed over a site glass 105 which, in turn, is disposed within the face seal flange 102. The face seal flange 102 is lined with a teflon diaphragm 106. The O-ring 107 provides a seal between the face seal flange 106 and the reservoir cavity 108. The air vent stop cock 111 allows excess air or gas to be bled from the system. Filtered fluid enters the reservoir 13 through the conduit 25 (see FIGS. 1 and 2) and through the fluid inlet 112. Filtered fluid is drawn out of the reservoir 13 through the fluid outlet 117 and through the three-way valve 28 and conduit 27 before entering the second pump 14 (see FIGS. 1 and 2).

FIG. 8 is an illustration of the flow path of the dual-stage pump system 10 shown in FIG. 1. A source bottle 16 provides fresh fluid to the first pump 11. The fluid 11 enters the pump 11 through a conduit 113 and then through the three-way valve shown at 21. The conduit 113 is normally open to the fitting 43. During the reload stroke, fluid flows from the source bottle 16 through the conduit 113, through the conduit 23 and into the process fluid cavity 38 (see FIG. 3) of the pump 11. After the reload stroke is finished, the solenoid 22 activates the valve 21 to close the pathway from the conduit 113 to the conduit 23 and opens the pathway from the conduit 23 to the conduit 24 which leads to the filter 12. During the dispensing stroke, fluid leaves the pump 11 through the conduit 23, through the conduit 24 and into the filter 12. As noted above, the filter 12 includes a vent 51 and a drain 47.

The fluid proceeds through the filter 12 through the conduit 25 and into the reservoir 13. Also noted above, the reservoir 13 is equipped with a vent or air vent stop cock 111.

Filtered fluid is drawn out of the reservoir 13 by the second pump 14. The fluid travels through the conduit 27 before entering the process fluid cavity 38 (see FIG. 3) of the second pump 14. During the reload stroke of the second pump 14, the pathway between the conduit **25*a* and the conduit 27 is open. At the end of the reload stroke, the solenoid 26 closes the pathway between the conduits 25*a* and 27 and opens the pathway between the conduits 27 and 114. The conduit 114 connects the three-way valve 28 to the three-way valve 32 (see FIG. 8). When fluid is to be dispensed, the solenoid connected to the three-way valve 32 opens the pathway between the conduit 114 and the dispensing outlet 115. If no fluid is to be dispensed, the solenoid connected to the three-way valve 32 opens the pathway between the conduit 114 and the recirculation conduit 17**.

Figure 9:
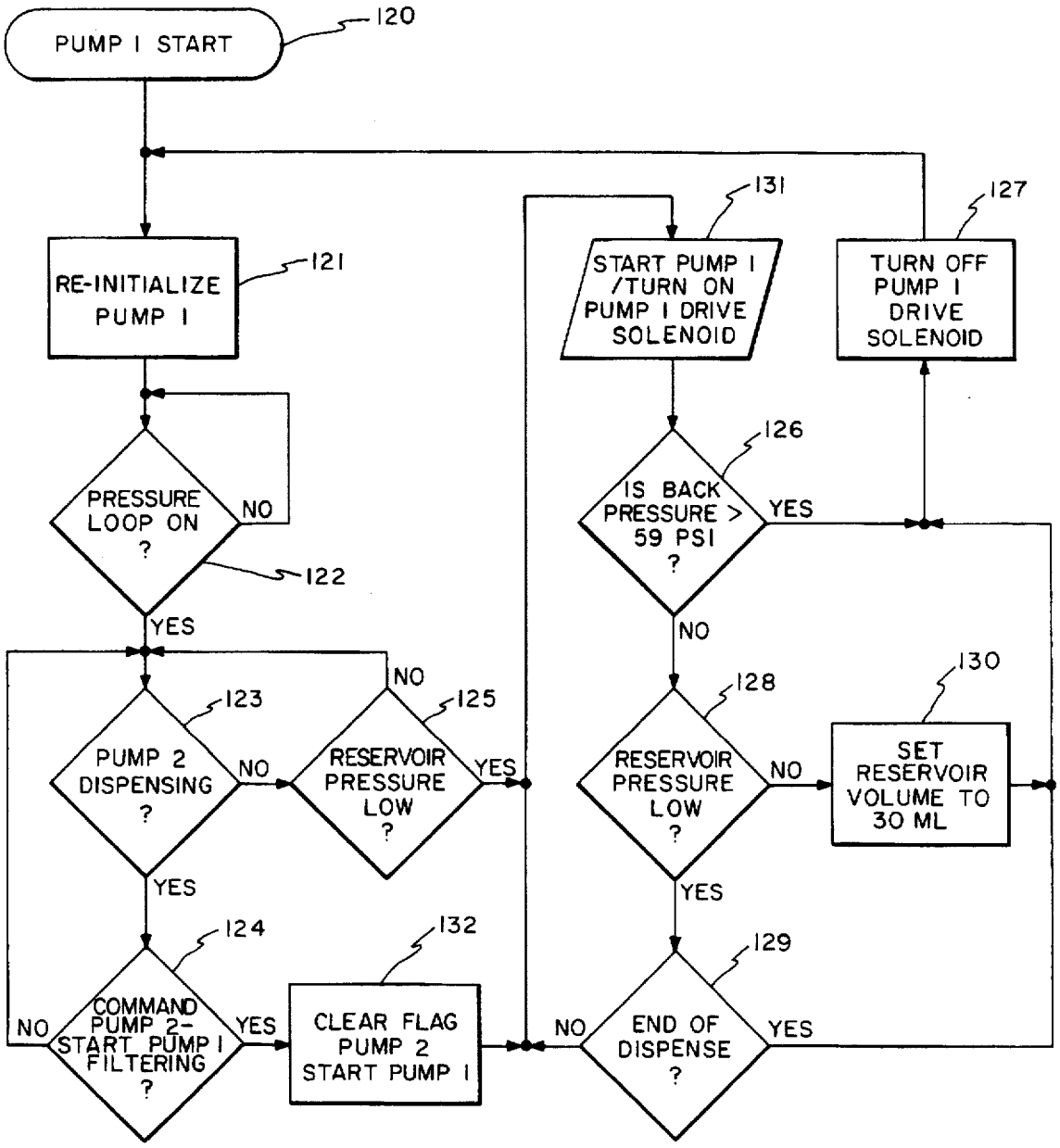
FIG. 9 is a flow diagram of the control means for the first pump of the dual-stage pump system shown in FIG. 1.
Figure 10:
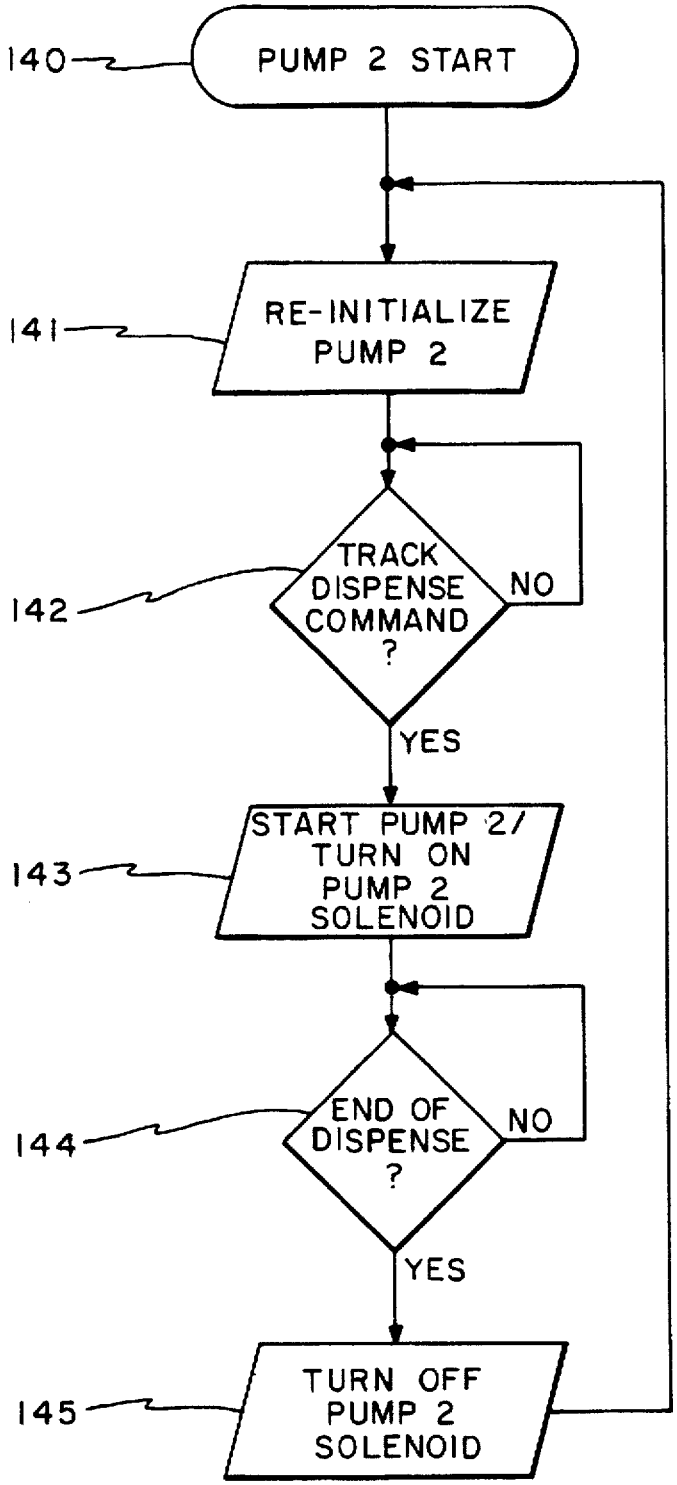
FIG. 10 is a flow diagram of the control means for the second pump of the dual-stage pump system shown in FIG. 1.

As seen in FIGS. 9 and 10, the first pump 11 and the second pump 14 are controlled separately by at least one programmable controller. Referring to FIG. 9, the pump is started at 120. The controller initializes the pump at 121 and confirms that the pressure transducer 95 (see FIG. 3) is on at 122. If the second pump 14 is dispensing at 123, then the controller checks whether the first pump is filtering ("yes or no" flag at location 124). If the second pump 14 is not running, i.e. filtering or reloading at 123 ("yes or no" flag at location 123), then the controller checks to see if the reservoir pressure is low at 125. If the reservoir pressure is low at 125, then the controller instructs the first pump 11 to start pumping fluid through the filter at 131. If the reservoir pressure is not low at 125, then the controller proceeds in a continuous loop until either the second pump 14 is running, i.e. dispensing, reloading or in a suckback mode and not idle) at 123 or the reservoir 13 pressure is low at 125.

The controller performs a back pressure check at 126. If the back pressure, as sensed by the transducer 95 associated with the first pump 11 is too great (i.e. more than about 52 psi) at 126, the controller switches the three-way valve 21 cutting off fluid communication between the conduits 23 and 24 (see FIG. 8). Typically, positive pressure in excess of 52 psi is an indication that the filter is clogged and a new filter cartridge needs to be installed. If the back pressure at the filter 12 is not too high at 126, the controller checks to see if the reservoir pressure is low at 128. If the reservoir pressure is low at 128, the controller checks to see if the first pump 11 is at the end of its dispense stroke at 129. If the first pump 11 is at the end of its dispense stroke at 129, then the controller switches the three-way valve 21 closing the pathway between the conduits 23 and 24 and opening the pathway between the conduits 113 and 23 so that the first pump 11 may commence the reload stroke. If the reservoir pressure is not low at 128, the controller sets the reservoir volume to the prescribed volume, in this case 30 milliliters, at 130 and prepares the three-way valve 21 to turn off at 127 and to begin a reload/reinitialization stroke at 121.

The controller of the system of the present invention also includes a settable alarm which is used to signal when the transducer in the first or the second pump senses that a negative pressure on the fluid is too low. The alarm indicating excessive negative pressure, for typical polyamides which the present invention is designed to dispense, should sound when such pressures reach 24 psi. However, for more viscous fluids, the alarm may be set to a different pressure. The setting on the alarm should generally correspond to a negative pressure which is below the pressure at which outgassing will occur in the liquid.

Referring to FIG. 10, the controller initiates the start-up of the second pump 14 at 140. The second pump 14 is initialized at 141 and the controller must be set to track the dispense command at 142. The three-way valve 28 is turned to the dispense position at 143, or the position where communication is established between the conduit 27 and the conduit 114 (see FIG. 8). At the end of the dispense stroke at 144, the controller switches the three-way valve 28 at 145 so that communication is closed between the conduits 27 and 114 and communication is opened between the conduits 27 and 25*a* so that the second pump 14 may withdraw fluid out of the reservoir 13 during its reload stroke.

Figure 11:
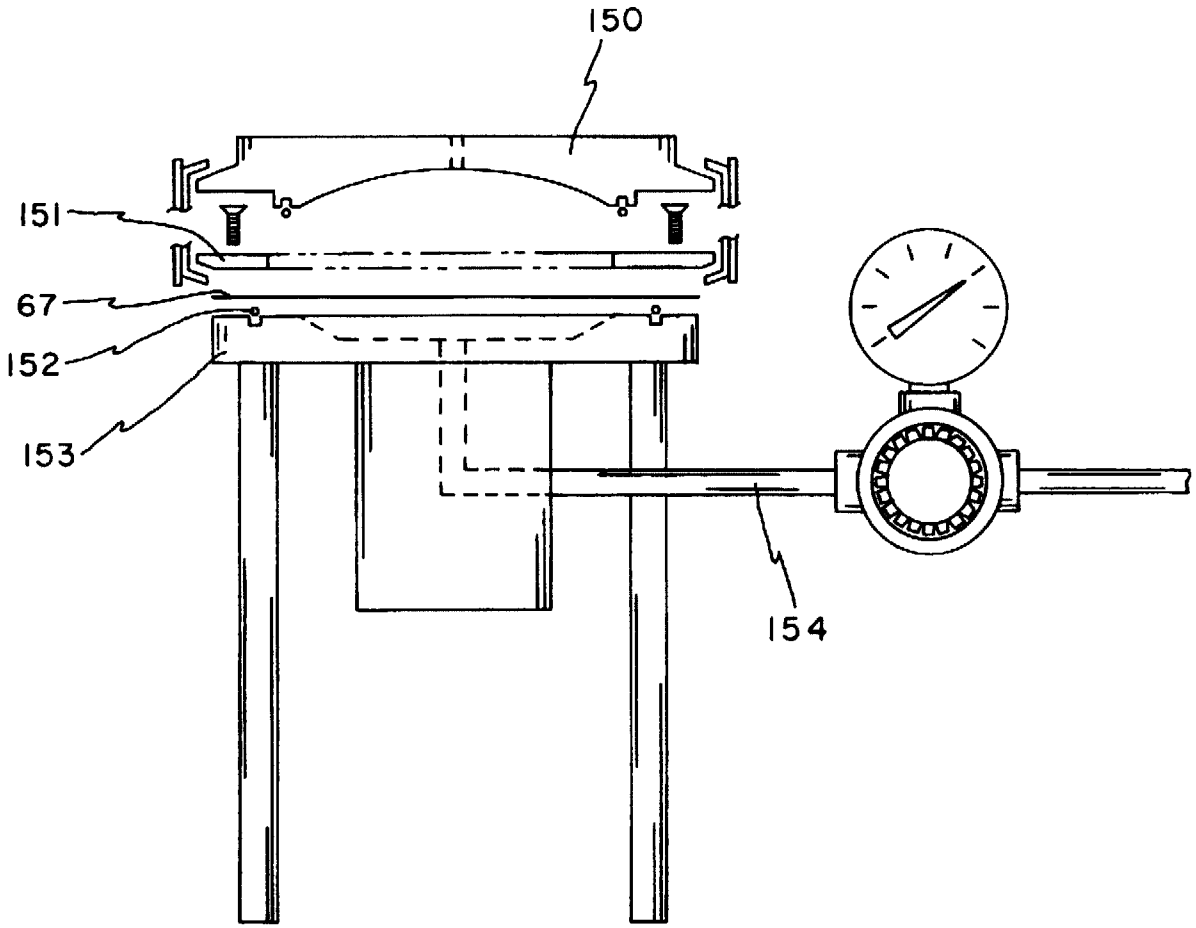
FIG. 11 is a front elevational view of the apparatus used for pre-forming the diaphragms used in the pumps shown in FIGS. 1 and 2.

To reduce and preferably eliminate unwanted residual negative and positive pressures caused by resilience in the material which comprises the diaphragm membrane, during both the dispense and reload strokes, the diaphragm membrane 67 is pre-stressed in a form 150 (see FIG. 11).

An O-ring 152 provides a seal between the diaphragm 67, the casing or fixture 153 and the face seal 151. Screws secure the pre-stress form 150, face seal 151 and fixture 153 together. A diaphragm pre-stress form 150 is mounted to a face seal 151 by a V-clamp like the clamp 101 in FIG. 4, which, in turn, is mounted over a diaphragm 67. Air pressure is supplied to the conduit 154 which presses the diaphragm 67 against the interior of the pre-stress form 150. In the preferred method, the interior geometry of the pre-stress form 150 is like or identical to the interior geometry of the process fluid cavity 38 (see FIG. 3).

It has been found that using the apparatus illustrated in FIG. 11 that the diaphragm 67 pressurized at 60 PSI for 30 minutes will be adequately pre-stressed to the geometries of the process fluid cavity 38 as represented by the pre-stress form 150. However, depending on the exact type and thickness of the diaphragm 67 used, the preferred air pressure may vary from about 40 PSI to about 80 PSI and the time period for the process may vary from about 20 to about 40 minutes.

Thus, an improved dual-stage pump system is provided with two hydraulically activated diaphragm pumps with improved accuracy. The system also includes a reservoir disposed between the filter and the second pump which acts as a source bottle for the second pump. The reservoir enables the first and second pumps to be operated at rates independent of one another. The method of manufacturing diaphragms disclosed by the present invention is applicable to pump systems used with all types of viscous fluids. The recirculation line of the dual-stage pump system made in accordance with the present invention also helps preserve polyamide fluids and other expensive fluids with limited shelf lives and varying viscosities, and also saves fluid which might otherwise be lost when filter cartridges are changed.

Although only one preferred embodiment of the present invention has been illustrated and described, it will at once be apparent to those skilled in the art that variations may be made within the spirit and scope of the present invention. Accordingly, it is intended that the scope of the invention be limited solely by the scope of the hereafter appended claims and not by any specific wording in the foregoing description.

We claim:

1. In a machine for dispensing liquids used in the manufacture of components which require the deposition of a layer of liquid to be placed on a workpiece, a dual stage pump system for pumping and filtering such liquids, the system comprising:

a first pumping means for pumping fluid from an input source through a filtering means, said first pumping means having a single port through which fluid both enters and exits a pumping chamber in said pumping means a second pumping means for pumping fluid filtered by the filtering means to and through a discharge outlet, the filtering means being disposed downstream of the first pumping means and upstream of said second pumping means, a three-way valve connected to said port, said valve having two positions, one position in which said chamber fluidly communicates with the input source, and a second position in which said chamber fluidly communicates with said filtering means, a fluid pathway connecting said filtering means and said second pumping means, a flow control valve disposed in said fluid pathway between said filtering means and said second pumping means, said flow control valve allowing flow of fluid out of said filter and controlling flow of fluid to a dispense port of said second pumping means, each of said first and second pumping means being a diaphragm-type pump having a diaphragm driven by an hydraulic drive liquid.

* * * * *